US007815560B2

(12) United States Patent
Hayasaka et al.

(10) Patent No.: US 7,815,560 B2
(45) Date of Patent: Oct. 19, 2010

(54) CENTRIFUGE HAVING PIVOTALLY SUPPORTED DOOR

(75) Inventors: Hiroshi Hayasaka, Hitachinaka (JP); Takahiro Shimizu, Toyota (JP); Yuki Shimizu, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 1059 days.

(21) Appl. No.: 11/525,835

(22) Filed: Sep. 25, 2006

(65) Prior Publication Data

US 2007/0072759 A1 Mar. 29, 2007

(30) Foreign Application Priority Data

Sep. 26, 2005 (JP) ..... P2005-278204

(51) Int. Cl.
*B04B 7/02* (2006.01)

(52) U.S. Cl. ..... 494/60; 494/16; 49/386

(58) Field of Classification Search ..... 494/12, 494/16–21, 60, 85; 210/360.1; 49/386
See application file for complete search history.

(56) References Cited

U.S. PATENT DOCUMENTS 5,067,938 A * 11/1991 Uchida et al. ..... 494/12
5,205,073 A * 4/1993 Lyons, Sr. ..... 49/386
6,021,606 A * 2/2000 Kos ..... 49/386
2007/0072759 A1* 3/2007 Hayasaka et al. ..... 494/60

FOREIGN PATENT DOCUMENTS

| | | |
|---|---|---|
| JP | 47-4774 | 9/1972 |
| JP | 52-9279 | 1/1977 |
| JP | 1-170454 | 12/1989 |
| JP | 2-24139 | 2/1990 |
| JP | 3-52048 | 5/1991 |
| JP | 5-266396 | 10/1993 |
| JP | 2005-034724 | 2/2005 |
| JP | 2008168253 A * | 7/2008 |

OTHER PUBLICATIONS

Japanese Office Action dated Jan. 12, 2010. Japanese Patent Application No. 2005-278204; 2 pages.

* cited by examiner

*Primary Examiner*—Charles E Cooley
(74) *Attorney, Agent, or Firm*—Antonelli, Terry, Stout & Kraus, LLP.

(57) ABSTRACT

A centrifuge includes a frame, a door, a restricting part, a first spring member, and a second spring member. The frame has an opening on top thereof, when the frame is disposed in an orientation in which the frame is intended to be placed. The door is movably supported on the frame to be capable of opening and closing the opening. The restricting part is provided on the frame and defines a prescribed region. The first spring member has one end pivotally supported on the door, and another end pivotally supported on the frame. The second spring member has one end pivotally supported on the door, and another end that is movable within the prescribed region.

9 Claims, 8 Drawing Sheets

CENTRIFUGE HAVING PIVOTALLY SUPPORTED DOOR

BACKGROUND OF THE INVENTION

The present invention relates to a centrifuge, and particularly to a centrifuge having a door that can be temporarily halted at a position between a closed state and a full-open state.

Centrifuges that use centrifugal force to separate samples are well known in the art. This type of centrifuge has a door that opens at a fixed angle and must be selected based on whether the door is designed to open at a large angle or at a small angle. If the door is designed to open at a large angle, it is difficult to reach the door when closing the same. Hence, these centrifuges are more difficult to operate. Centrifuges having doors that open to a smaller angle are inconvenient when performing maintenance operations, such as replacing the rotor or cleaning the interior of the centrifuge.

To overcome these problems, Japanese Patent Application Publication No. 2005-34724 discloses a centrifuge having a hinge for generating a fixed drag torque when opening and closing the door, and a gas spring for urging the door in the opening direction. The drag torque of the hinge and the urging force of the gas spring are balanced so as to halt the door at a desired position.

SUMMARY OF THE INVENTION

However, in the centrifuge disclosed in Japanese Patent Application Publication No. 2005-34724, the balance between the drag torque of the hinge and the urging force of the gas spring tends to change as the gas spring ages or reaches the end of its life. Further, it is not always possible to stop the door in the same position each time. For these reasons, this type of centrifuge has been difficult to operate.

In view of the foregoing, it is an object of the present invention to provide a centrifuge capable of facilitating operations for opening and closing the door.

This and other objects of the present invention will be attained by a centrifuge including a frame, a door, a restricting part, a first spring member, and a second spring member. The frame has an opening on top thereof, when the frame is disposed in an orientation in which the frame is intended to be placed. The door is movably supported on the frame to be capable of opening and closing the opening. The restricting part is provided on the frame and defines a prescribed region. The first spring member has one end pivotally supported on the door, and another end pivotally supported on the frame. The second spring member has one end pivotally supported on the door, and another end that is movable within the prescribed region.

DESCRIPTION OF THE PREFERRED EMBODIMENTS

A centrifuge 1 according to a preferred embodiment of the present invention will be described with reference to FIGS. 1 through 8. In the following description, a front-to-rear direction will refer to the directions indicated in FIGS. 1 and 7B.

Figure 1:
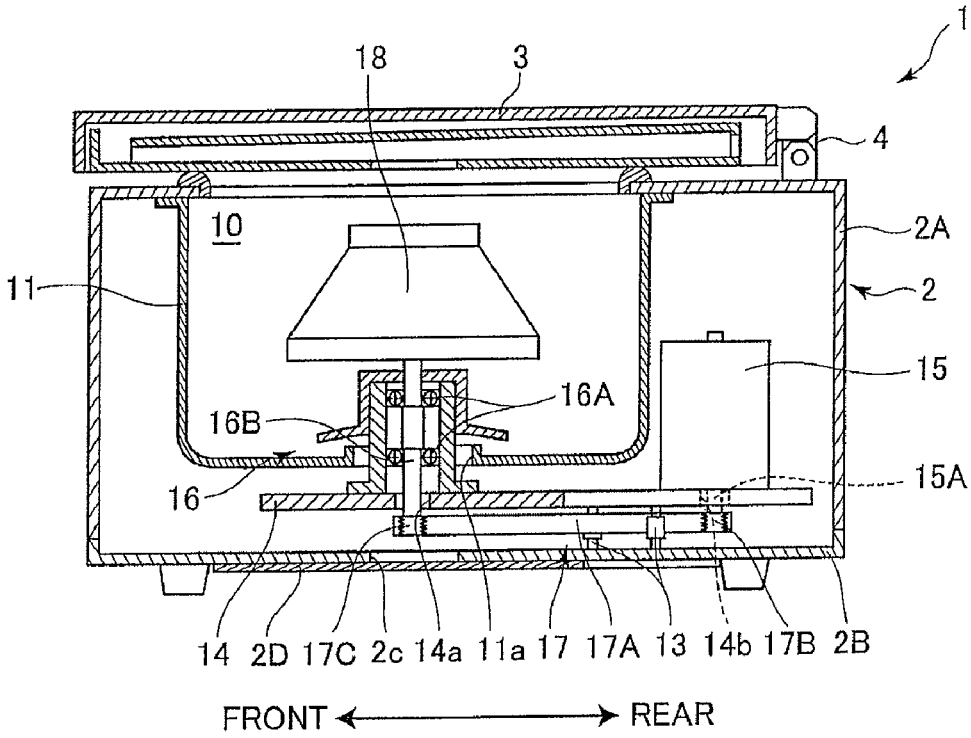
FIG. 1 is a schematic diagram showing the general structure of a centrifuge according to a preferred embodiment of the present invention.
Figure 2:
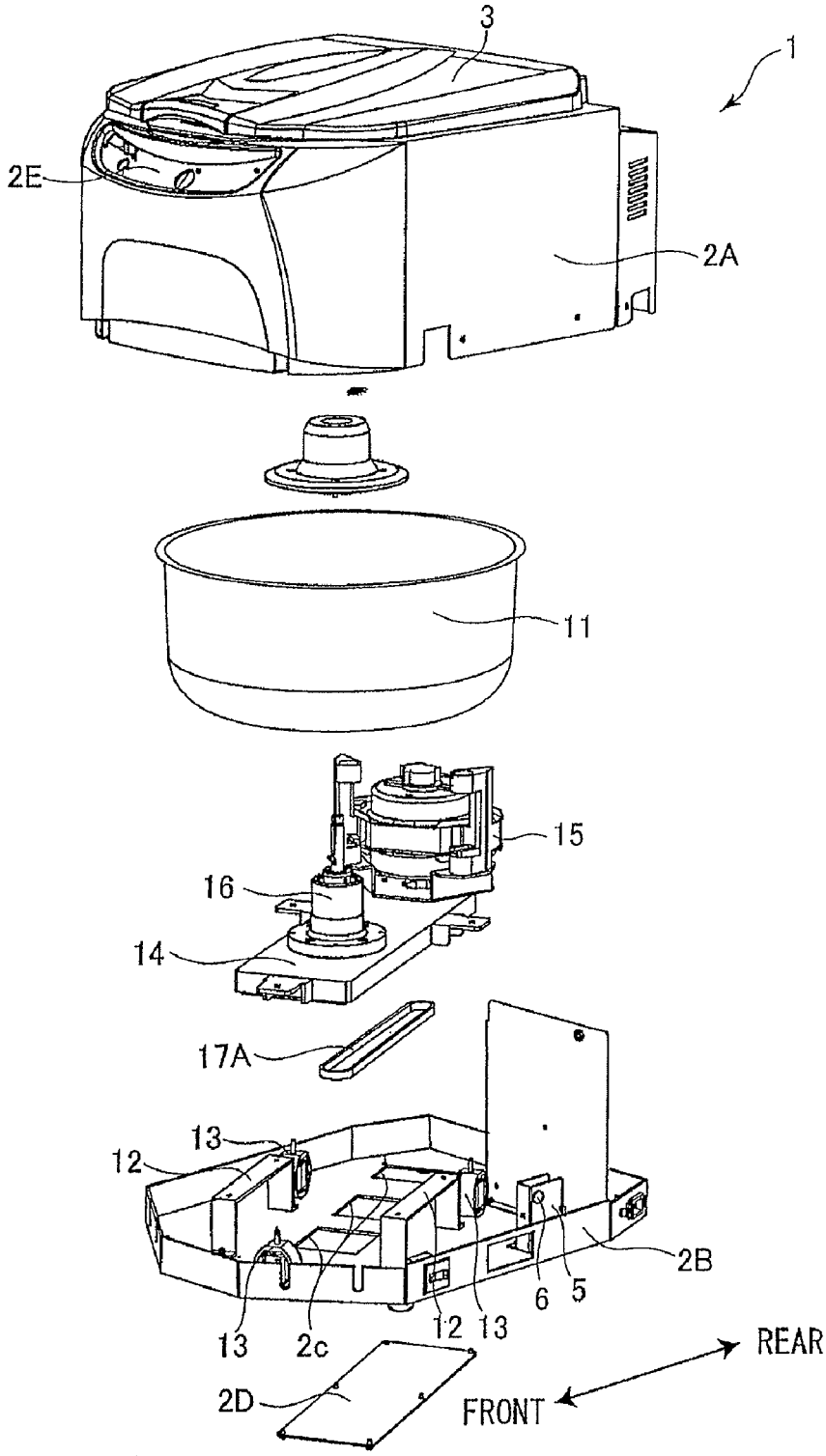
FIG. 2 is an exploded perspective view of the centrifuge according to the preferred embodiment.
Figure 6A:
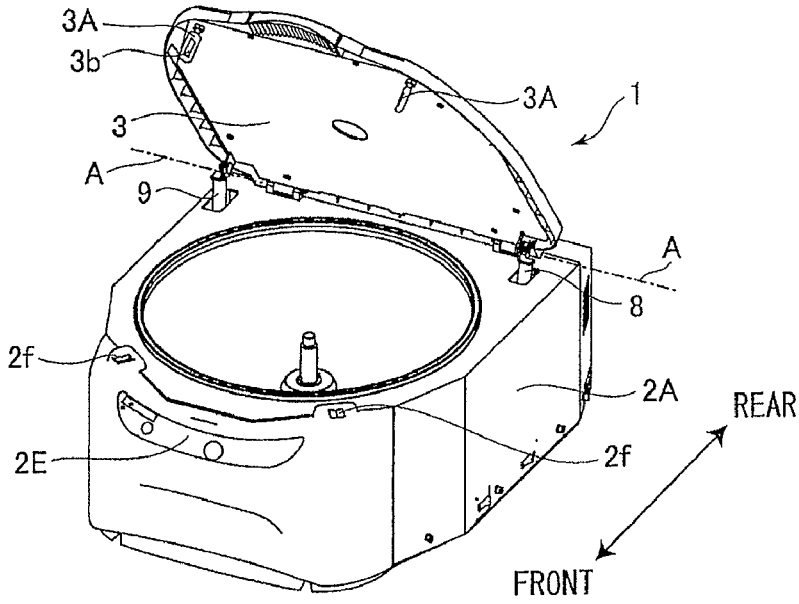
FIG. 6A is a perspective view showing the centrifuge of the preferred embodiment when the door is in a half-open state.
Figure 6B:
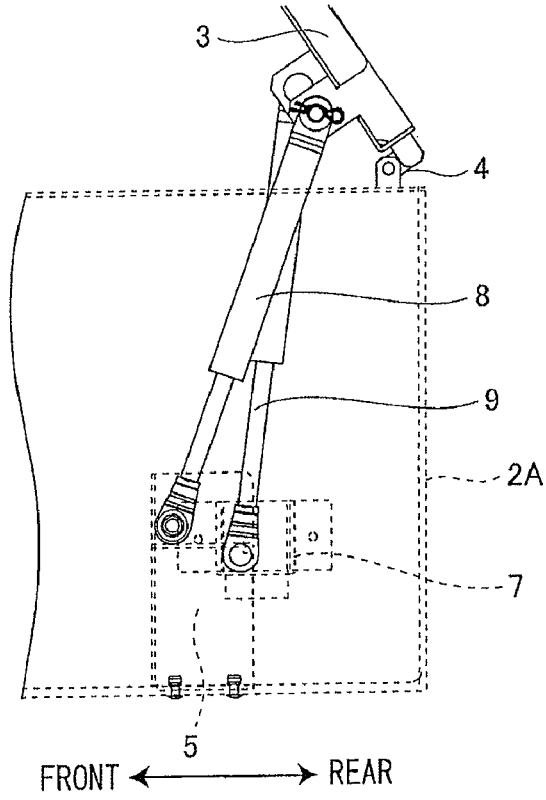
FIG. 6B is a side view in partial phantom showing the state of first and second gas springs in the centrifuge of the preferred embodiment when the door is in the half-open state.

As shown in FIGS. 1 and 2, the centrifuge 1 includes a frame 2 and a door 3. The frame 2 constitutes an outer frame of the centrifuge 1 and is box-shaped with an opening in the top side. The frame 2 includes an upper frame 2A, and a base 2B. As shown in FIG. 2, three openings 2*c* are formed in the base 2B for inspecting or replacing a belt 17A described later. The openings 2*c* are normally covered with a base cover 2D. A control panel 2E is disposed on the front surface of the upper frame 2A and includes various operating buttons and a display unit. As shown in FIG. 6A, insertion holes 2*f* are formed in the top front surface of the upper frame 2A at left and right ends thereof for inserting protruding parts 3A described later. Electromagnetic solenoids (not shown), each having a plunger (not shown), are provided in the upper frame 2A below the insertion holes 2*f*.

Hinges 4 are provided on top of the upper frame 2A near the rear side thereof. The door 3 is rotatably fixed to the upper frame 2A via the hinges 4 and is capable of rotating about a rotational axis A (see FIG. 6A) for opening and closing over the opening in the top of the frame 2. The inner portion of the door 3 is configured of a steel plate for ensuring safety while a rotor 18 described later is rotated. As shown in FIG. 6A, the protruding parts 3A are disposed on the front edge of the door 3 at positions corresponding to the insertion holes 2*f*. Plunger penetration holes 3*b* are formed in the protruding parts 3A for allowing penetration of the plungers mentioned above. When the door 3 is in a closed state shown in FIG. 2, the plungers are inserted into the plunger penetration holes 3*b* for locking the door 3 to the frame 2. By pressing a door opening switch provided on the control panel 2E, the electromagnetic solenoid is operated to disengage the plungers from the plunger penetration holes 3*b* in order to unlock the door 3.

Figure 3:
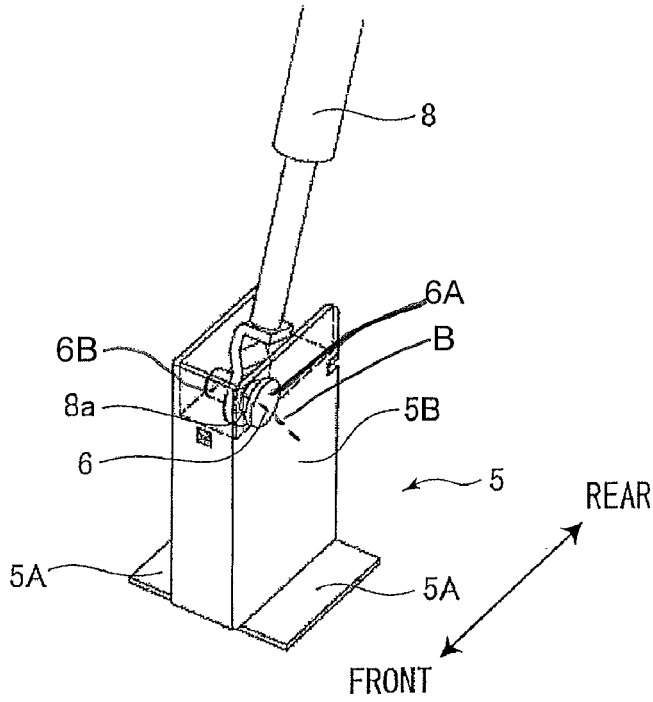
FIG. 3 is a perspective view showing a first bracket employed in the centrifuge of the preferred embodiment.
Figure 9:
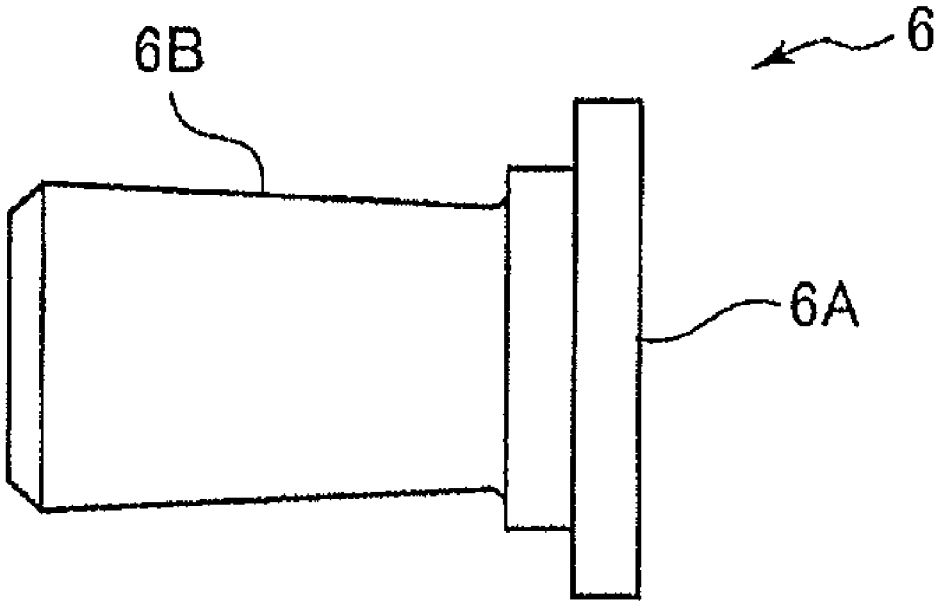
FIG. 9 is a side view of the plug shown in FIG. 3.

As shown in FIG. 2, a first bracket 5 is disposed on the base 2B in the right rear section thereof when viewed from the front of the base 2B. As shown in FIG. 3, the first bracket 5 includes a base part 5A fixed to the base 2B, and a spring fixing part 5B shaped substantially like a rectangular parallelepiped. A recessed part is formed in the top end of the spring fixing part 5B, and a through-hole (not shown) is formed in the wall of the spring fixing part 5B that configure the recessed part. A plug 6 is inserted through the through-hole and is fixed to the wall of the spring fixing part 5B by welding. The plug 6 has a flange part 6A and a shaft part 6B. The shaft part 6B has an outer diameter that tapers toward the flange part 6A side as shown in FIG. 9.

Figure 4:
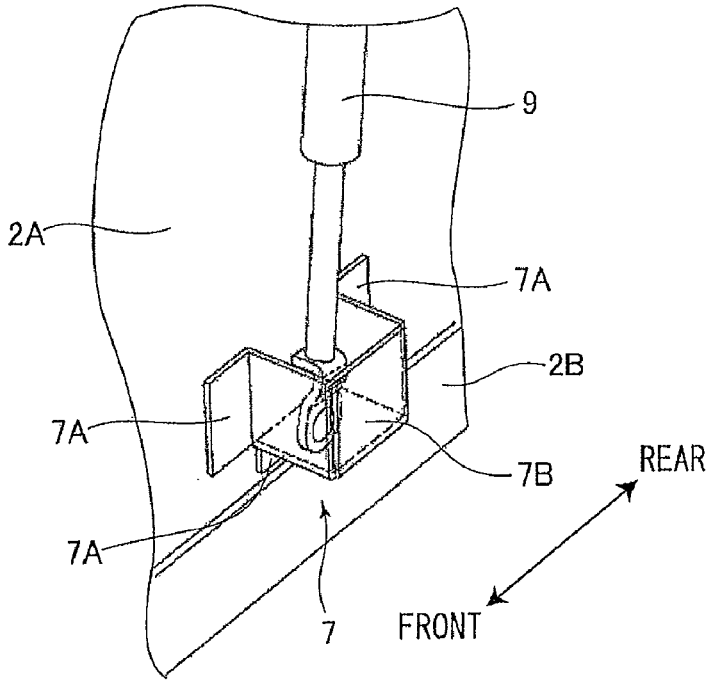
FIG. 4 is a perspective view showing a second bracket employed in the centrifuge of the preferred embodiment.
Figure 5A:
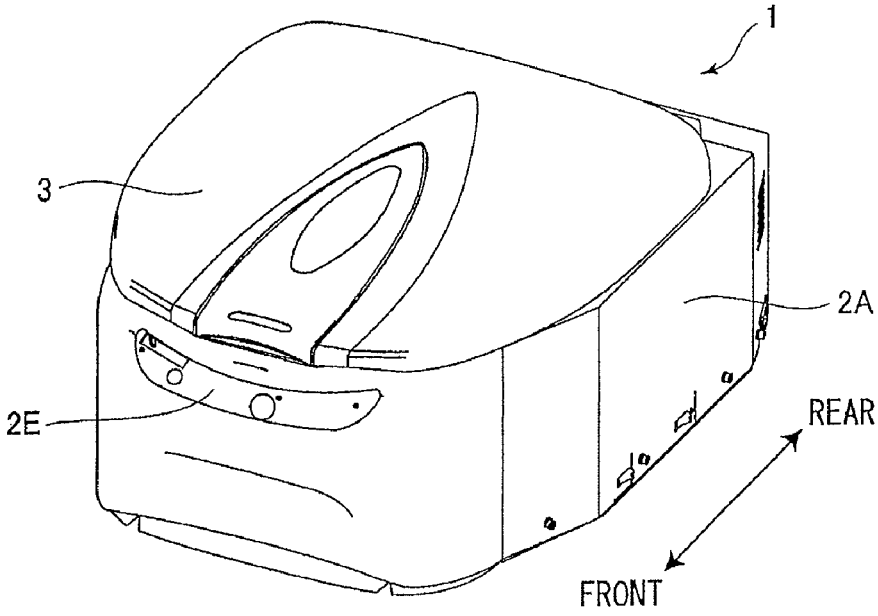
FIG. 5A is a perspective view showing the centrifuge of the preferred embodiment when the door is in a closed state.
Figure 5B:
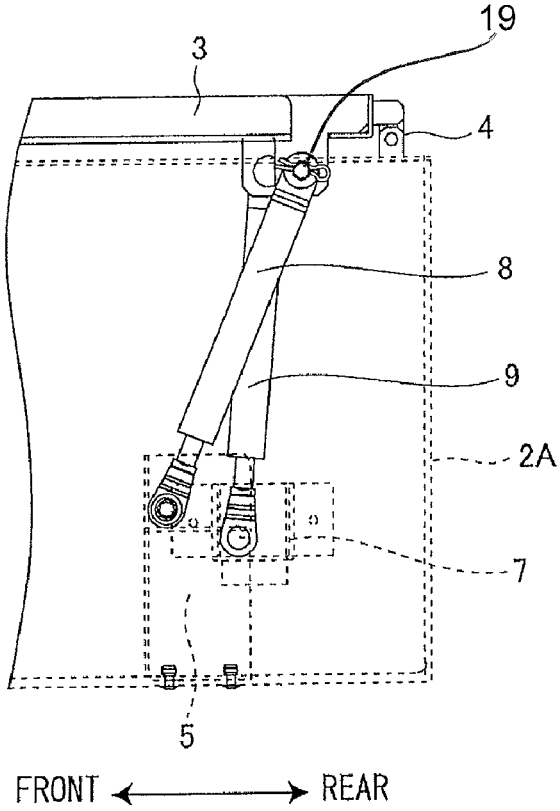
FIG. 5B is a side view in partial phantom showing the state of first and second gas springs in the centrifuge of the preferred embodiment when the door is in the closed state.

As shown in FIGS. 4 and 5B, a second bracket 7 is provided on a left side wall of the upper frame 2A when viewed from the front thereof. The second bracket 7 is configured of three bracket fixing parts 7A, and a recess defining part 7B. The second bracket 7 is fixed to the side wall of the upper frame 2A by fixing the bracket fixing parts 7A with bolts (not shown). The recess defining part 7B defines a substantially cube-shaped recess together with the side wall of the upper frame 2A and functions as a restricting part.

As shown in FIG. 5B, a first gas spring 8 and a second gas spring 9 are provided inside the frame 2. In the preferred embodiment, the first and second gas springs 8 and 9 are configured of springs having common specifications. Hence, the first and second gas springs 8 and 9 have substantially the same size and substantially the same load-stroke characteristics. The first gas spring 8 is disposed inside the frame 2 in the right rear when viewed from the front of the frame 2. The top end of the first gas spring 8 is rotatably supported on the door 3 and is retained by a pin 19. With this construction, the bottom end of the first gas spring 8 is somewhat restricted in lateral movement. Hence, by setting the length of the shaft part 6B of the plug 6 greater than the lateral movement (along the central axis B of the plug 6) allowed in the lower end of the first gas spring 8, a fastening pin is unnecessary at the lower end of the first gas spring 8. Therefore, this construction simplifies the assembly operation.

As shown in FIG. 3, the lower end of the first gas spring 8 is positioned in the recessed part of the first bracket 5. For explanatory purposes, the first bracket 5 is shown in phantom in FIG. 3 so that the lower end of the first gas spring 8 is visible in the recessed part. A plug insertion hole 8*a* is formed in the lower end of the first gas spring 8 for receiving the inserted plug 6. With this construction, the lower end of the first gas spring 8 is rotatably supported in the first bracket 5. When the door 3 is in the closed state, the first gas spring 8 urges the door 3 in the opening direction. Further, as described above, the shaft part 6B of the plug 6 has the outer diameter that tapers toward the flange part 6A. As a result, when a load is applied to the first gas spring 8, the lower end of the first gas spring 8 tends to slide along the tapered surface of the shaft part 6B toward the flange part 6A so that the lower end of the first gas spring 8 does not slip off the plug 6.

The second gas spring 9 is disposed in the left rear section of the frame 2 when viewed from the front of the frame 2. As shown in FIG. 5B, the top end of the second gas spring 9 is rotatably supported on the door 3 at a position farther forward than the position at which the top end of the first gas spring 8 is supported. The lower end of the second gas spring 9 is disposed in the second bracket 7, as shown in FIG. 4. For explanatory purposes, the recess defining part 7B is shown in phantom in FIG. 4 so that the lower end of the second gas spring 9 is visible in the second bracket 7. When the door 3 is in the closed state, the second gas spring 9 urges the door 3 in the opening direction.

The centrifuge 1 further includes a bowl 11, a plurality (three in the preferred embodiment) of dampers 13, a motor base 14, a motor 15, a shaft unit 16, a driving force transmitting mechanism 17, and a rotor 18.

The bowl 11 is formed in a cylindrical shape having a bottom. A shaft unit insertion hole 11*a* is formed in the bottom portion of the bowl 11. The bowl 11 is disposed inside the frame 2 and is fixed to and supported on the frame 2 via bowl mounting parts 12. The bowl 11 defines a rotor chamber 10. The three dampers 13 are arranged in a triangular shape on the base 2B. The motor base 14 is substantially box-shaped with an open bottom and is supported on the dampers 13 mounted on the base 2B. For explanatory purposes, the motor base 14 is shown in a simplified plate shape in FIG. 1. A portion of the motor base 14 is positioned opposite the bowl 11. A shaft through-hole 14*a* is formed in the portion of the motor base 14 opposing the bowl 11. An output shaft through-hole 14*b* is formed in a portion of the motor base 14 that does not oppose the bowl 11.

The motor 15 is disposed on a side of the bowl 11 on the portion of the motor base 14 that does not oppose the bowl 11. The motor 15 has an output shaft 15A that penetrates the output shaft through-hole 14*b* and extends toward the base 2B. The output shaft 15A functions to output a driving force of the motor 15. The shaft unit 16 is disposed in the portion of the motor base 14 that opposes the bowl 11. The shaft unit 16 penetrates the shaft unit insertion hole 11*a* so that the top portion of the shaft unit 16 is positioned inside the rotor chamber 10. The shaft unit 16 includes two bearings 16A, and a vertically extended drive shaft 16B rotatably supported in the bearings 16A. The drive shaft 16B penetrates the shaft through-hole 14*a*, with one end positioned inside the rotor chamber 10 and the other end positioned below the motor base 14.

The driving force transmitting mechanism 17 is disposed below the motor base 14 and includes the belt 17A, a first pulley 17B, and a second pulley 17C. The first pulley 17B is coaxially fixed to the lower end of the output shaft 15A, and the second pulley 17C is coaxially fixed to the lower end of the drive shaft 16B. The belt 17A is mounted over the first and second pulleys 17B and 17C. The driving force transmitting mechanism 17 having this configuration transmits a driving force from the motor 15 to the drive shaft 17B. Further, the first and second pulleys 17B and 17C are positioned opposite the openings 2*c* formed in the base 2B. A portion of the belt 17A corresponding to an approximate center region between the first and second pulleys 17B and 17C opposes the openings 2C. The rotor 18 is connected to the upper end of the drive shaft 16B and is capable of rotating together with the drive shaft 16B for separating a target material from a sample.

Next, the operations of the centrifuge 1 having the aforementioned structure will be described. The motor 15 begins operating when a user pushes a start switch (not shown) on the centrifuge 1. At this time, the motor 15 drives the output shaft 15A to rotate, and the driving force is transmitted from the output shaft 15A to the drive shaft 16B via the belt 17A. As the drive shaft 16B rotates, the rotor 18 rotates in association therewith and separates a target material from the sample in the rotor 18. The rotation of the rotor 18 produces vibrations in the shaft unit 16, motor base 14, and motor 15, but the dampers 13 can attenuate these vibrations.

Next, the mechanism for opening and closing the door 3 will be described. The door 3 is capable of rotating within a prescribed angular range (from 0° to about 80° in the preferred embodiment) that includes the closed state shown in FIG. 5A, the half-open state shown in FIG. 6A, and the full-open state shown in FIG. 7A. The force required for opening the door 3 can be expressed as the moment determined by the distance between the center of gravity of the door 3 and the hinges 4 about which the door 3 rotates, and the weight of the door 3. When the door 3 is in the closed state, the distance between the center of gravity of the door 3 and the hinges 4 is far, so that the moment for closing the door 3 (hereinafter referred to as the door closing moment) is large. As the door 3 is opened, the distance between the center of gravity of the door 3 and the hinges 4 in the front-to-rear direction narrows, and the door closing moment decreases. Hence, it is possible to open the door 3 by applying a moment with the first and second gas springs 8 and 9 to the door 3 for opening the same that is larger than the door closing moment.

Figure 8:
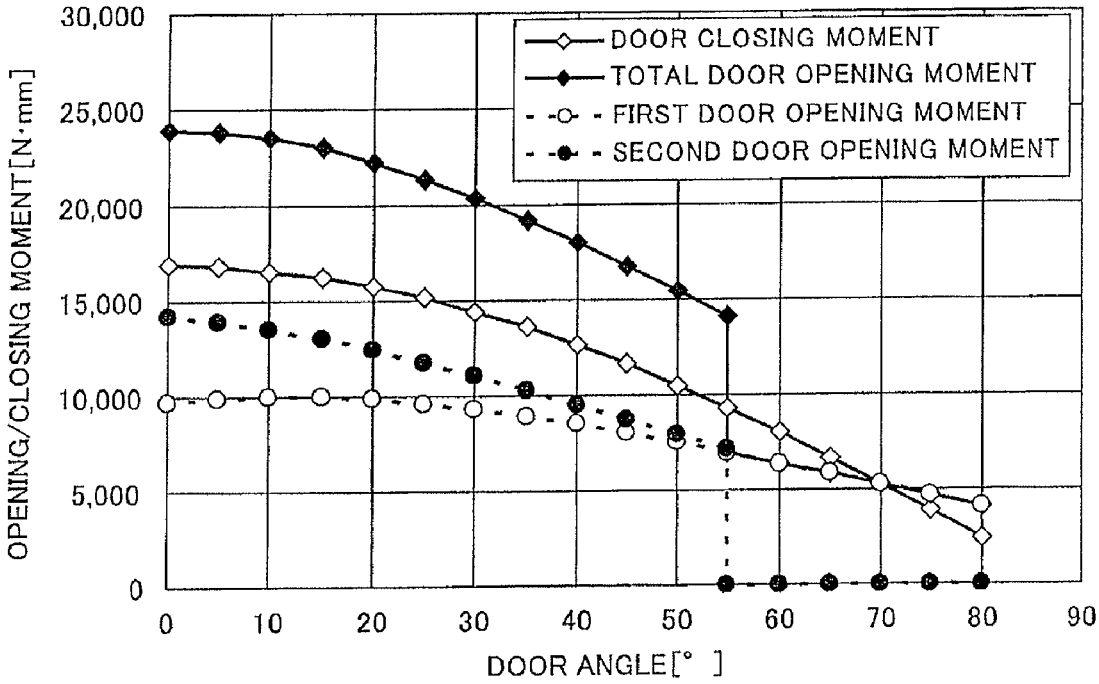
FIG. 8 is a graph showing relationships among a door closing moment, a first door opening moment, a second door opening moment, and a total door opening moment in the centrifuge of the preferred embodiment.

FIG. 8 shows relationships among the door closing moment, a moment for opening the door 3 with the first gas spring 8 (hereinafter referred to as the first door opening moment), a moment for opening the door 3 with the second gas spring 9 (hereinafter referred to as the second door opening moment), and a total moment including the first and second door opening moments (hereinafter referred to as the total door opening moment). In the graph of FIG. 8, the X-axis represents the angle at which the door is opened, and the Y-axis represents the opening/closing moment. When the open angle of the door is 0°, the second door opening moment is larger than the first door opening moment because the position at which the top end of the second gas spring 9 is supported on the door 3 is farther from the hinges 4 than the position at which the top end of the first gas spring 8 is supported on the door 3.

When the open angle of the door is 0° (i.e., when the door 3 is in the closed state), the total door opening moment is larger than the door closing moment. However, the door 3 does not open because the plungers are inserted through the plunger penetration holes 3*b*. Further, as shown in FIG. 5B, when the door 3 is in the closed state, the second gas spring 9 is in a seated position in which the lower end of the second gas spring 9 contacts both the lower wall and side wall of the second bracket 7. When the user presses the door opening switch, the plungers are withdrawn from the plunger penetration holes 3*b*, thereby unlocking the door 3. Since the total door opening moment is greater than the door closing moment at this time, the door 3 opens when unlocked.

As the open angle of the door increases, the distance between the center of gravity of the door 3 and the hinges 4 in the front-to-rear direction grows smaller, reducing the door closing moment. At the same time, the distances between the hinges 4 and the first and second gas springs 8 and 9 in the front-to-rear direction decrease, as does the elastic force of the first and second gas springs 8 and 9, thereby reducing the first and second door opening moments. When the angle of the door is about 55°, the second gas spring 9 is extended to its longest state (see FIG. 6B), and the second door opening moment is 0. At this time, the total door opening moment and the door closing moment are substantially equivalent. Hence, when the door angle is about 55°, the door 3 halts temporarily (the half-open state shown in FIG. 6A).

Figure 7A:
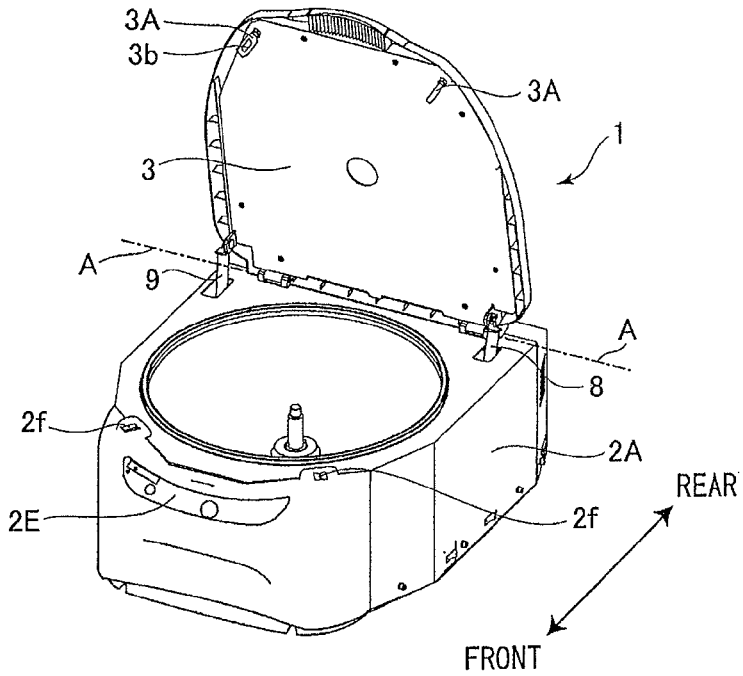
FIG. 7A is a perspective view showing the centrifuge of the preferred embodiment when the door is in a full-open state.
Figure 7B:
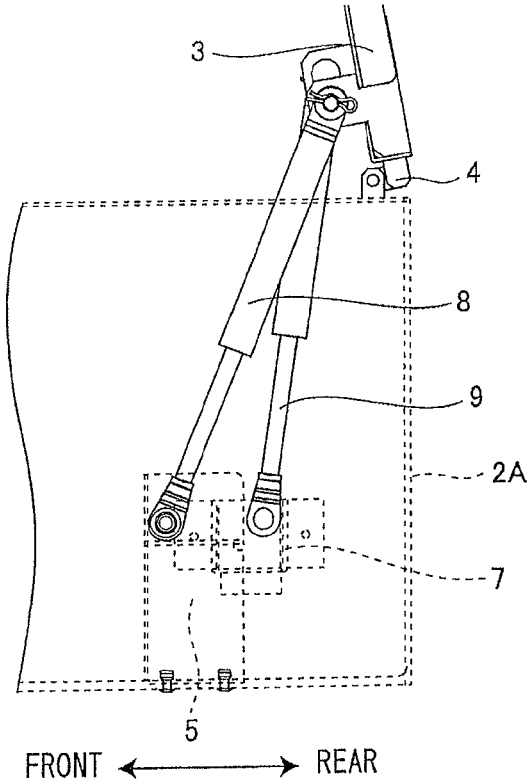
FIG. 7B is a side view in partial phantom showing the state of first and second gas springs in the centrifuge of the preferred embodiment when the door is in the full-open state.

From the half-open state, the door 3 can be opened to an angle of about 80° (the full-open state shown in FIG. 7A) through force applied by the user and the first door opening moment. When the door 3 is in the full-open state, the first gas spring 8 is extended to its limit. The second gas spring 9 is also extended to its limit, while the door 3 is moved from the half-open state to the full-open state. However, since the lower end of the second gas spring 9 is free, the second gas spring 9 rises together with the door 3 (non-seated position, the lower end of the second gas spring 9 is away from the lower wall of the second bracket 7), as shown in FIG. 7B. In this way, the lower end of the second gas spring 9 can be moved within the second bracket 7 between the seated position and the non-seated position.

With the construction described above, the door closing moment, first door opening moment, second door opening moment, and total door opening moment can be set to prescribed relationships, as shown in FIG. 8, so that the door 3 reliably halts temporarily in the half-open state. Hence, when it is unnecessary to open the door 3 fully, as when inserting a sample or removing a separated sample, the door 3 can be left in the half-open state where it is easier to reach when the user needs to close the door 3 thereafter, thereby improving the ease of operating the door 3. Further, when performing maintenance, such as replacing the rotor 18 or cleaning the interior of the centrifuge 1, the door 3 can be opened to the full-open state. Since the user can freely select either the half-open state or the full-open state of the door 3, this construction improves the operability of the door 3.

Further, a substantially cube-shaped recessed part is formed by the second bracket 7 and the side wall of the upper frame 2A, as described above, and the lower end of the second gas spring 9 is disposed inside this recessed part. Accordingly, the lower end of the second gas spring 9 can be reliably maintained in the seated position while the door 3 changes from the closed state to the half-open state. Further, the first and second gas springs 8 and 9 are substantially the same size and have substantially the same load-stroke characteristics, thereby reducing the number of types of parts required and, therefore, reducing costs.

While the invention has been described in detail with reference to specific embodiments thereof, it would be apparent to those skilled in the art that many modifications and variations may be made therein without departing from the spirit of the invention, the scope of which is defined by the attached claims. For example, gas springs are used in the preferred embodiment to open and close the door 3, but it is possible to use another type of spring and dampers to achieve the same mechanism described above for opening and closing the door. Further, in the preferred embodiment described above, the door 3 opens to the half-open state due to the first and second door opening moments and without any force applied by the user. However, by selecting different strengths of the gas springs, it is possible to configure the door 3 to open only slightly when the door 3 is unlocked and to require the user to exert some force together with the first and second door opening moments to open the door to the half-open state.

What is claimed is:

1. A centrifuge comprising:

a frame having an opening on top thereof;

a motor disposed in the frame to generate a driving force;

a bowl disposed in the frame, the bowl defining a rotor chamber;

a rotor disposed in the rotor chamber and rotatable by the driving force of the motor;

a door pivotally supported on the frame and being capable of opening and closing the opening;

a first spring member having one end pivotally supported on the door, and another end pivotally supported on the frame; and a second spring member having one end pivotally supported on the door, and another end supported movably within a prescribed region on the frame.

2. The centrifuge according to claim 1, wherein the another end of the second spring member is movable between a seated position and a non-seated position, and the another end of the second spring member is in the seated position when the door is in a position between a closed state and a half-open state, and is in the non-seated position when the door is between the half-open state and a full-open state.

3. The centrifuge according to claim 1, wherein the first spring member and the second spring member are the same size and have the same load-stroke characteristics.

4. The centrifuge according to claim 1, wherein a recessed part is provided to restrict a movement of the another end of the second spring member.

5. A centrifuge comprising:

a frame having a front wall, a rear wall, side walls, a bottom wall and a top wall, the top wall having an opening;

a motor disposed in the frame to generate a driving force;

a bowl disposed in the frame, the bowl defining a rotor chamber;

a rotor disposed in the rotor chamber and rotatable by the driving force of the motor;

a door supported on the top wall by a hinge and pivotally movable to open and close the opening;

a first spring member having one end pivotally supported on the door and another end pivotally supported on the bottom wall and located close to one side wall of the frame; and a second spring member having one end pivotally supported on the door that is positioned farther than the first spring member from the hinge and another end supported movably within prescribed region on another side wall of the frame.

6. The centrifuge according to claim 5, wherein restricting means is provided on the another side wall to restrict a movement of the another end of the second spring member in a top-to-bottom direction and in a front-to-rear direction within the prescribed region.

7. The centrifuge according to claim 5, wherein the first spring member and the second spring member urge the door in an opening direction when the door is in a closed state.

8. The centrifuge according to claim 7, wherein a protruding part is provided on the door to be inserted in a hole formed in the top wall of the frame when the door is in a closed state.

9. The centrifuge according to claim 7, wherein when an open angle of the door increases during door opening from the closed state, the distances between the hinge and the first and second spring members in a front-to-rear direction are reduced so that a total door opening moment produced by the first and second spring members is reduced.

* * * * *